United States Patent [19]

Fieschi

[11] Patent Number: 4,901,657

[45] Date of Patent: Feb. 20, 1990

[54] MULTIFUNCTION SEWING MACHINE WITH TAPE FEEDING, CUTTING AND HEMMING APPARATUS

[75] Inventor: Giorgio Fieschi, Milan, Italy

[73] Assignee: Rockwell-Rimoldi S.p.A., Italy

[21] Appl. No.: 220,540

[22] Filed: Jul. 18, 1988

[30] Foreign Application Priority Data

Oct. 9, 1987 [IT] Italy ..... 22210 A/87

[51] Int. Cl.[4] ..... D05B 35/02; D05B 35/04

[52] U.S. Cl. ..... 112/152; 112/130; 112/141; 112/143; 112/DIG. 2

[58] Field of Search ..... 112/152, 130, 122, 141, 112/143, 136, 137, 121.27, 121.26, 142, 149, 153, DIG. 2

[56] References Cited

U.S. PATENT DOCUMENTS

| | | | |
|---|---|---|---|
| 1,826,677 | 10/1931 | Sailer | 112/141 |
| 4,067,273 | 1/1978 | Marforio | 112/152 X |
| 4,120,252 | 10/1978 | Glassman | 112/143 |
| 4,640,206 | 2/1987 | Nishikawa | 112/143 |
| 4,817,544 | 4/1989 | Ackermann et al. | 112/141 |

OTHER PUBLICATIONS

Brochure, "Rimoldi 527".
Brochure, "Rimoldi Orion 627".
Brochure, "Rimoldi Koln IMB 79".

*Primary Examiner*—Andrew M. Falik
*Attorney, Agent, or Firm*—Laff, Whitesel, Conte & Saret

[57] ABSTRACT

A sewing machine comprising a feed unit 10 to feed a folded tape beneath a presser foot 8, a cutting unit 15 to cut the tape upstream of the presser foot and a hemming group 21 to guide and shape the hem of a workpiece upstream of the presser foot. The feed unit 10, cutting unit 15 and hemming group 21 comprise a feed guide 11, a cutting member 16 and a hem folder 22 respectively, which are individually and selectively movable from a rest position in which they are spaced apart from a workpiece supporting table 3 and the presser foot 8 to a working position in which they are disposed close to the supporting table and presser foot to perform their operating functions.

8 Claims, 1 Drawing Sheet

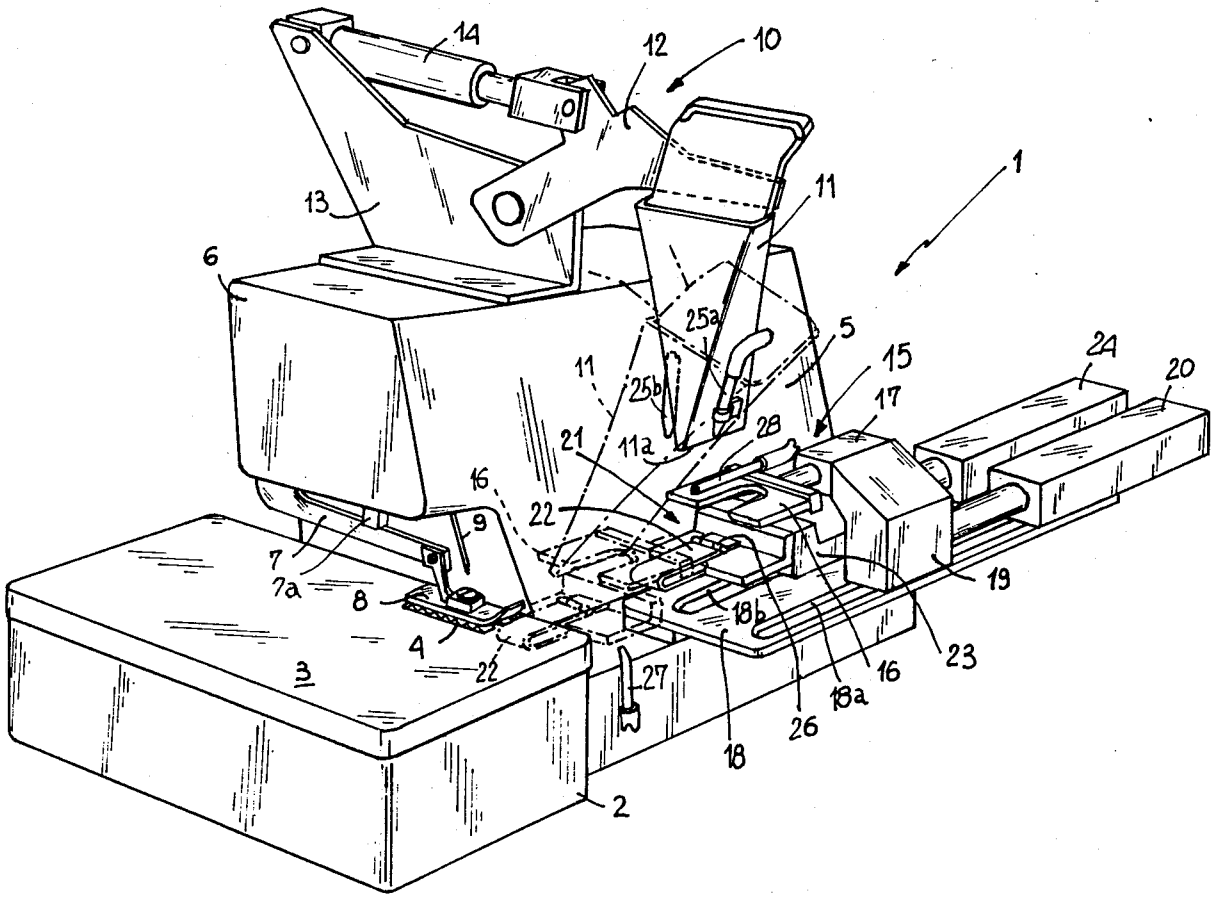
1
2
3
4
5
6
7
7a
8
9
10
11
11a
12
13
14
15
16
17
18
18a
18b
19
20
21
22
23
24
25a
25b
26
27
28

MULTIFUNCTION SEWING MACHINE WITH TAPE FEEDING, CUTTING AND HEMMING APPARATUS

BACKGROUND OF THE INVENTION

1. Field of the Invention

The present invention relates to a multifunction sewing machine comprising: a bed defining a workpiece supporting table along which a workpiece is caused to move; a standard raising from the bed and supporting a head in cantilevered fashion; a presser foot fastened to the lower part of a presser foot holder housed in the head, said foot holder acting such as to push the presser foot towards the workpiece supporting table; and sewing means acting close to the presser foot to sew the workpiece.

2. Prior Art

It is known that when vests, singlets or the like have to be produced, generally provision is first of all made for the assembling of the main component parts thereof by mere sewing. Then support tapes folded astride of the fabric are applied to the neck and optionally the sleeves along the respective edges thereof. Once said tapes are applied, they avoid possible ravelling of the corresponding fabric edges and represent an aesthetic ornament for the product.

It is also provided that the lower edges of the singlet should be folded and sewn so that they look backfolded towards the inner side of the singlet when the latter is ready for use. This operation too is carried out both for aesthetic purposes and in order to avoid ravelling of the fabric edges.

A specific sewing machine has been required for carrying out each of the above listed operations. In greater detail, the assembling of the main parts of the singlet is generally achieved by the use of an overlock sewing machine capable of executing overedge stitches. For the application of tape, the use of a sewing machine which, unlike the preceding one, is equipped with a feed guide fastened to the head and disposed before the presser foot. The tape, first in the form of a continuous strip wound to form a roll, is folded in a longitudinal direction when it passes through the feed guide and comes out of the same close to the presser foot so that it is engaged by the line of stitching together with the workpiece. Finally, to carry out the hemming of the lower singlet edge, the use of a third sewing machine substantially identical to the one used during the assembling step is required, but further provided, with a hem folder fixed to the supporting table before the presser foot. The hem folder is designed to house the folded edge of the workpiece and to suitably shape and guide it during its displacement towards the presser foot.

The necessity of using three different sewing machines involves cost problems for the user due to the fact that he is obliged to purchase them all, as well as further problems for service and finally he must find sufficient room to install them.

SUMMARY OF THE INVENTION

It is therefore an object of the present invention to solve the drawbacks of the known art by providing a sewing machine capable of performing not only normal stitching but also stitching adapted to apply support tapes as well as contour sewings for hemming the workpiece edges.

The foregoing and still further objects which will become more apparent in the course of the present description are substantially attained by a multifunction sewing machine, particularly adapted to produce singlets and the like, comprising: a feed unit to feed the presser foot with a support tape and provided with a feed guide movable in a substantially vertical direction from a rest position in which it is overhanging with respect to the presser foot to a working position in which it is disposed near the presser foot to guide said tape close to the presser foot itself; a cutting unit provided with a cutting element movable parallelly to and before the standard from a rest position in which it is spaced apart sideways from the supporting table to a working position in which it is disposed close to the supporting table in order to cut said tape in a portion thereof included between the presser foot and the feed guide; and a hemming group provided with a hem folder movable parallelly to the standard from a rest position in which it is spaced apart sideways from the supporting table to a working position in which it is disposed on the supporting table before the presser foot to guide and shape one edge of the workpiece.

BRIEF DESCRIPTION OF THE DRAWING

Further features and advantages will best be understood from the detailed description of a preferred embodiment of a multifunction sewing machine particularly adapted to produce singlets and the like, in accordance with the present invention. Said description will be given hereinafter by way of non-limiting example with reference to the accompanying drawing, in which the only figure is a perspective view of a sewing machine in accordance with the present invention where the feed guide, cutting member and hem folder are shown both in a rest condition (solid line) and in a working condition (dotted line).

DESCRIPTION OF THE PREFERRED EMBODIMENT

Referring to the drawing, the multifunction sewing machine of the invention has been generally identified by reference numeral 1. In known and conventional manner, the sewing machine 1 comprises a bed 2 on which a workpiece supporting table 3 is defined, along which table a workpiece is caused to move by the action of feed dogs 4. A standard 5 rises from the bed 2 and it supports a head 6 disposed in cantilevered fashion above the supporting table 3. A presser foot 7 holder 7 is mounted in the head 6 to the lower part of said holder being fastened a presser foot 8 which is pushed, due to the spring action exerted on the presser foot holder by ferrule 7(*a*), towards the supporting table 3 close to the feed dogs 4.

Also operatively engaged in the head 6 is a needle bar not shown in the figure which supports a needle 9 at the lower part thereof, said needle being provided with a substantially vertical reciprocating movement so that it may carry out stitchings on the workpiece in the region of the presser foot 8, in combination with other known means.

The sewing machine 1 further comprises a feed unit 10 through which a tape formerly in the form of a ribbon wound on a roller, can be fed to the presser foot 8 during the execution of a line of stitching. The feed unit 10 comprises a feed guide 11 known per se and conventional, shaped in such a manner that it can longitudinally half-fold the tape while the latter slides along the guide.

In an original manner, the feed guide 11 is fixedly connected to a free end of a swinging arm 12 rotatably mounted to a bracket 13 fixed above the head 6. A first fluid-operated cylinder 14 pivoted to the bracket 13 acts upon the swinging arm 12 to cause the movement of the feed guide 11 in a substantially vertical direction from a rest position in which, as shown in solid line, said guide is overhanging with respect to the presser foot 8, to a working position in which, as shown in dotted line, it has its lower end 11a disposed before the presser foot 8 to send the tape beneath the latter, together with the workpiece.

Advantageously, fastened to the feed guide 11 is at least a first blowing nozzle **25*a* disposed on the side opposite that occupied by the presser foot so that an air flow slightly touching the lower end 11*a* of guide 11 can be produced. At least a second blowing nozzle 25*b* is also disposed on the opposite side with respect to the first nozzle 25*a* so that an air flow oriented towards the supporting table 3 can be produced when the feed guide 11 is in its working position. Due to the combined action of nozzles 25*a* and 25*b*, at the beginning of the sewing an end portion of the tape coming out of the feed guide 11 can be suitably directed, so that said end portion can be automatically inserted beneath the presser foot 8** when the feed guide is lowered to its working position.

In an original manner a cutting unit 15 is associated with the feed unit 10 in order to cut the tape coming out of the feed guide 11 upstream of the presser foot 8 at the end of stitching. The cutting unit 15 comprises a cutting member 16 known per se and conventional, provided with a fluid-operated actuation cylinder 7 slidably mounted along a guide element 18 extending parallelly to and before the standard 5. In greater detail the cutting member 16 is connected to the guide element 18 by a first support block 19 slidably engaged along at least a first slot **18*a* formed in the guide element. A second fluid-operated cylinder 20, which is fixed with respect to the guide element 18, acts upon the first support block 19 to move the cutting member 16 from a rest position in which it is spaced apart sideways from the supporting table 3, to a working position in which, as shown in dotted line, it is disposed close to the supporting table 3 before the presser foot 8 so that it can cut the tape in a portion thereof included between the presser foot and the lower end 11*a* of the feed guide 11**.

Advantageously the sewing machine 1 is also provided with a hemming group 21 consisting of a hem folder 22 known per se and conventional, movable parallelly to the standard 5 from a rest position in which it is spaced apart sideways from the supporting table 3 to a working position in which it is disposed on the supporting table before the presser foot 8 to suitably guide and shape an edge of the workpiece as it runs beneath the presser foot. To this end the hem folder 22 is fixedly connected to a second support block 23 slidably engaged along at least a second slot **18*b* formed in the guide element 18. Acting on the second support element 23 is a third fluid-operated cylinder 24 which is fixed with respect to the guide element 18** and is designed to cause the hem folder to move from its rest position to its working position and vice versa.

The hem folder 22 is hinged according to a horizontal axis, to a plate 26 fixed to the support block 23 and it can be oriented in a vertical direction to allow the fabric edge to be easily introduced thereinto. Then it is disposed horizontally again to enable the sewing to take place regularly. It is to be noted in this connection that a third blowing nozzle 27 is provided which is fastened to the bed 2 and vertically directed so that the air flow it produces hits the hem folder 22 when the latter is moved from its rest position to its working position. The action of nozzle 27 causes the tilting of the hem folder which is brought to its operating position in a vertical arrangement without the manual intervention of the operator being necessary to this end. The operator now arranges the workpiece on the machine. Thereafter, she manually pivots the hem folder 22 downwardly so as to receive the edge of the workpiece to be hemmed. Then, the operator starts the stitching operation.

At the end of the stitching, the hem folder 22 is manually raised to its vertical position to allow the workpiece to be disengaged therefrom and, upon the action of a fourth blowing nozzle 28 fixed to the cutting member 16, is arranged again in a horizontal direction when it reaches its rest position.

Operation of the sewing machine according to the invention described above mainly as regards structure, is as follows.

When, as shown in FIG. 1, the feed unit 10, cutting unit 15 and hemming group 21 are in their respective rest positions, the sewing machine 1 can be used to perform, by means of normal stitchings, the assembling of the main component parts of the workpiece consisting of a singlet, for example. During this working step the feed and cutting units 10 and 15 as well as the hemming group do not at all hinder the movements the operator must accomplish to suitably guide the workpiece under the presser foot 8 while the stitching is being carried out.

At the end of the assembling operation the feed guide 11 can be brought to its working position, upon command of the first fluid-operated cylinder 14. The tape to be applied to the workpiece is arranged so that it is engaged in the feed guide 11, its end portion coming out of the end 11a thereof. Said portion is automatically inserted under the presser foot 8, upon the action of nozzles **25*a* and 25*b*** at the end of the feed guide displacement to its working position.

In this manner the sewing machine lends itself to carry out the application of a tape astride of the neck edges of the singlet and optionally of the sleeve edges. In fact, as the workpiece moves along the supporting table 3, the folded tape coming out of the feed guide 11 is subjected to engage along the workpiece edges to be fastened thereto due to the stitching executed close to the presser foot 8. When all tape has been applied, the feed guide 11 is brought again to its rest position, still being acted upon by the first fluid-operated cylinder 14. Then the second fluid-operated cylinder 20 is actuated and, as a result, the cutting member 16 is brought from its rest position to its working position so that by the action of said actuation cylinder it can execute the cutting of the tape upstream of the presser foot 8.

Advantageously, due to the lifting of the feed guide 11, the tape is tensioned in the portion included between the presser foot 8 and the lower guide end 11a, which allows an easier cutting by the cutting member 16. When the cutting operation is over, the tape is so arranged that the end portion thereof comes out of the feed guide and **11*a* in order to be automatically engaged beneath the presser foot 8** at the beginning of the next application step.

Upon completion of the tape application the workpiece can be submitted to hemming operations in the region of the edges devoid of tape. To this end the hem folder 22 is brought from its rest position to its working position, upon command of the third fluid-operated cylinder 24, so that it can suitably fold and guide the workpiece edge beneath the presser foot 8 in known manner. Once the hemming operation has been completed the hem folder 22 is brought again to its rest position and the sewing machine 1 can be used again to perform assembling operations giving thus rise to a new work cycle.

The present invention attains the intended purposes.

The present sewing machine can in fact perform all sewing operations necessary to produce singlets and the like, replacing the functions of three different types of sewing machines hitherto used in the known art. All that involves important savings on the part of the purchaser as regards both the purchase and service expenses and the installation room.

Furthermore, as tapes are cut by the cutting unit 15 upstream of the presser foot, it is advantageously possible to install suction devices or blowing devices to cause the chain formed by the free stitches executed at the beginning of sewing to be folded over the fabric. In this manner the chain is engaged by the stitching subsequently executed on the workpiece so that the risk of a possible opening of the sewing stitches can be avoided.

Said devices could not be used in known sewing machines designed for the application of tapes. In fact in these machines the cutting of the tape at the end of a line of sewing has been always carried out downstream of the presser foot in order to prevent a tape to be applied to a workpiece from being disengaged from the presser foot.

Under this situation the formation of a free chain was impossible and, as a result, it was useless to apply a device to fold the chain.

It is also to be noted that, due to the presence of blowing nozzles **25*a* and 25*b*, the execution of the cutting upstream of the presser foot does not involve any restriction as regards the practicalness of use of the sewing machine of the invention. In fact, as in known machines, no manual intervention is required for inserting the end portion of the tape beneath the presser foot 8** in order to start sewing.

A further advantage is offered by the elimination of the manual operations necessary to achieve the above specified relevant positionings of the hem folder.

Obviously the present invention is susceptible of many modifications and variations, all falling within the scope of the inventive idea characterizing it.

What is claimed is:

1. A multifunction sewing machine comprising a bed defining a workpiece supporting table along which a workpiece is caused to move;

a standard raising from the bed and supporting a head in cantilevered fashion;

a presser foot fastened to the lower part of a presser foot holder;

sewing means acting close to said presser foot to sew the workpiece;

a feed unit provided with a tape feed guide to feed a tape close to said presser foot itself; said feed unit having a bracket fixed to the head, a swinging arm rotatably mounted to the bracket according to a horizontal axis and supporting the feed guide and a fluid-operated cylinder acting between the bracket and the swinging arm to move the feed guide from a rest position to a working position;

a cutting unit provided with a cutting element to cut said tape in a portion thereof included between said presser foot and said feed guide;

a hemming group provided with a hem folder to guide and shape one edge of said workpiece.

2. A sewing machine as claimed in claim 1, wherein said cutting unit and hemming group comprises respective support blocks supporting the cutting member and hem folder respectively and being slidably guided along at least a guide element extending parallel to and before the standard, as well as individually and selectively movable upon the action of respective fluid-operated cylinders to bring the cutting member and hem folder from their respective rest positions to their respective working positions.

3. A sewing machine as claimed in claim 1, wherein associated with said hemming group is at least a blowing nozzle fastened to the machine bed and arranged to produce an air flow facing upwardly in order to cause the pivoting of the hem folder when the latter is brought from a rest position to a working position, said hem folder being supported by means for pivoting said hem folder according to a substantially horizontal axis.

4. A sewing machine as claimed in claim 1, wherein associated with said hemming group is at least a blowing nozzle fastened to the cutting member, said blowing nozzle oriented in a horizontal direction and arranged in such a manner that said blowing nozzle directs the hem folder in a horizontal direction when the hem folder is brought to a rest position, said hem folder being supported by means for pivoting said hem folder according to a horizontal axis.

5. A multifunction sewing machine comprising a bed defining a workpiece supporting table along which a workpiece is caused to move;

a standard raising from the bed and supporting a head in cantilevered fashion;

a presser foot fastened to the lower part of a presser foot holder;

sewing means acting close to said presser foot to sew the workpiece;

a feed unit provided with a feed guide to feed a tape close to said presser foot;

a cutting unit provided with a cutting member, means for moving said cutting member parallel to and before the standard from a rest position in which it is spaced apart sideways from the supporting table to a working position in which it is disposed close to the supporting table in order to cut said tape in a portion thereof included between the presser foot and the feed guide;

a hemming group provided with a hem folder to guide and shape one edge of the workpiece wherein said cutting unit and hemming group comprise respective support blocks supporting the cutting member and hem folder respectively and being slidably guided along at least a guide element extending parallel to and before the standard as well as individually and selectively movable upon the action of respective fluid-operated cylinders to bring the cutting member and hem folder from their respective rest positions to their respective working positions.

6. A multifunction sewing machine comprising a bed defining a workpiece supporting table along which a workpiece is caused to move;

a standard raising from the bed and supporting a head in cantilevered fashion;

a presser foot fastened to the lower part of a presser foot holder;

sewing means acting close to said presser foot to sew the workpiece;

a feed unit provided with a feed guide to feed a tape close to said presser foot; a pair of blowing nozzles are at least associated with said feed guide, a first blowing nozzle being fastened to the feed guide on the opposite side with respect to the presser foot and being designed to produce an air flow slightly touching the lower end of said feed guide and a second blowing nozzle being fastened to the feed guide on the opposite side with respect to the first blowing nozzle and being designed to produce an air flow directed towards the workpiece supporting table, said first and second blowing nozzles cooperating together to orient an end portion of a tape coming out of said lower feed guide and so that said end portion is adapted to be disposed beneath the presser foot when the feed guide is brought to a working position;

a cutting unit provided with a cutting element to cut said tape in a portion thereof included between said presser foot and said feed guide;

a hemming group provided with a hem folder to guide and shape one edge of the workpiece.

7. A multifunction sewing machine comprising: a bed defining a workpiece supporting table along which a workpiece is caused to move;

a standard raising from the bed and supporting a head in cantilevered fashion;

a presser foot fastened to the lower part of a presser foot holder;

sewing means acting close to said presser foot to sew the workpiece;

a feed unit provided with a feed guide to feed a tape close to the presser foot;

a cutting unit provided with a cutting element to cut said tape in a portion thereof included between said presser foot and said feed guide;

a hemming group provided with a hem folder to guide and shape one edge of the workpiece, said hem folder being supported by means for pivoting said hem folder according to a horizontal axis, associated with said hemming group is at least a blowing nozzle fastened to the machine bed and arranged to produce an air flow facing upwardly in order to cause a pivoting of the hem folder when the hem folder is brought from a rest position to a working position.

8. A multifunctional sewing machine comprising a bed defining a workpiece supporting table along which a workpiece is caused to move;

a standard raising from the bed and supporting a head in cantilevered fashion;

a presser foot fastened to the lower part of a presser foot holder;

sewing means acting close to said presser foot to sew the workpiece;

a feed unit provided with a feed guide to feed a tape close to the presser foot;

a cutting unit provided with a cutting member to cut said tape in a portion thereof included between said presser foot and said feed guide;

a hemming group provided with a hem folder to guide and shape one edge of the workpiece, associated with said hemming group is at least a blowing nozzle fastened to the cutting member, said blowing nozzle oriented in a horizontal direction and arranged in such a manner that said blowing nozzle directs the hem folder in a horizontal direction when the hem folder is brought to a rest position, said hem folder being supported by a means for pivoting said hem folder according to a horizontal axis.

* * * * *